United States Patent [19]

Pearson

[11] 4,414,875

[45] Nov. 15, 1983

[54] GANG SAW APPARATUS

[75] Inventor: H. C. Pearson, Beaverton, Oreg.

[73] Assignee: Portland Iron Works, Portland, Oreg.

[21] Appl. No.: 287,181

[22] Filed: Jul. 27, 1981

[51] Int. Cl.[3] ..... B27B 5/34

[52] U.S. Cl. ..... 83/508.3; 83/425.4; 83/504

[58] Field of Search ..... 83/425.4, 428, 499, 83/504, 508.3, 508.2, 665

[56] References Cited

U.S. PATENT DOCUMENTS

| | | | |
|---|---|---|---|
| 1,390,958 | 9/1921 | Hulbert | 83/508.3 X |
| 2,440,158 | 4/1948 | Sly | 83/508.3 X |
| 3,202,189 | 8/1965 | Pearson | 83/169 |

FOREIGN PATENT DOCUMENTS

| | | | |
|---|---|---|---|
| 315594 | 11/1971 | U.S.S.R. | 83/508.3 |

*Primary Examiner*—Frank T. Yost

*Attorney, Agent, or Firm*—Kolisch, Hartwell & Dickinson

[57] ABSTRACT

Saw apparatus including an elongate power-driven saw arbor, and a collar mounting a saw encircling the arbor and slidable axially on the arbor. The collar is moved axially on the arbor to shift the position of the saw by an elongate shifter bar seating within a channel extending along the arbor, the bar being connected to the collar through an attachment which provides a single anchoring connection of the collar and shifter bar. This enables centrifugal force produced with rotation of the arbor to maintain the plane of the saw collar normal to the axis of the arbor.

5 Claims, 6 Drawing Figures

GANG SAW APPARATUS

BACKGROUND AND SUMMARY

This invention relates to saw apparatus, and more particularly to such apparatus which includes multiple saws mounted on a saw arbor with such saws being laterally adjustable on the arbor. Saw apparatus of this description is exemplified by a so-called gang rip saw, which includes multiple circular saws which are adjusted along the arbor and laterally of each other to change the width of the boards cut by the machine.

More specifically, this invention concerns an improvement in saw apparatus of the type illustrated in my earlier U.S. Pat. No. 3,202,189. The rip saw disclosed in this patent includes an elongate power-driven saw arbor which is splined, i.e. provided with elongate keyways or channels extending axially therealong. Saw collars which encircle the arbor and which are used in the mounting of circular saws are movable axially to and fro on the arbor. A pair of rigid keys or shifter bars seated within channels provided on diametrically opposite sides of the arbor are joined at one set of ends to each saw collar. These keys or bars have opposite ends secured to what is referred to in the patent as a shifter mechanism. Movement of the collar along the arbor is produced through movement of the shifter mechanism in a direction extending axially of the arbor, which movement through the pair of bars is transmitted to the collar secured to the opposite ends of these bars.

The apparatus just briefly described and disclosed in my earlier patent has proven to be a very satisfactory machine in affording, as it does, the capability of shifting multiple circular saws along an arbor with such saws being positionable relatively close together on the arbor, enabling the production of narrowly cut boards in a single pass through the machine. While the saw apparatus has proven to be highly successful, it has been subject to certain deficiencies which have proved troublesome in manufacturing the machine, even when the most careful manufacturing procedures are followed.

Further explaining, as earlier conceived by me, two shifter bars or keys were joined to opposite sides of a saw collar. This was to insure that the collar when moved would have a force applied to regions disposed on diametrically opposite sides of the arbor whereby the collar would be shifted without skewing. With the arbor stationary, a collar is best shifted along the length of the arbor using a pair of such diametrically opposed shifter bars or keys. However, with the provision of two keys, in assembling the keys, the collar and the shifter mechanism, extremely close manufacturing tolerances must be followed if the collar in the final assembly is to have a position where the plane thereof is exactly normal to the arbor axis. Any slight canting or skewing of the collar in its final assembled condition, even to the extent that one side is displaced axially from the other a few thousandths of an inch, results in vibration, burned saws, and saw cuts of greater than desired width. Furthermore, and in this connection it should be remembered that a saw arbor may be rotated in speeds in excess of 3000 rpm, in some instances it has been noted that while the saw collar is shifted easily with the arbor stationary, with the arbor rotating at cutting speed, the saw collar becomes essentially locked to the arbor and unshiftable.

This invention is based on the discovery that a body such as a collar encircling a shaft and rotating with the shaft tends, under the action of centrifugal force, to assume a position wherein the plane of such body is normal to the shaft axis. Further, if a means is provided for shifting this body which is anchored to this body at a single point, which anchoring point further rotates with the shaft and body, when an axial thrust is imparted to the body through this single anchored connection, binding does not occur. Apparently what happens is that the body initially tends to be skewed slightly, with the body rapidly returning to a plane normal to the axis of the shaft, but displaced along the length of the shaft to the extent of the original slight skewing.

Following the invention, binding of a saw collar on the arbor, as the result of rotation of the arbor at high speeds, does not occur. The need for connecting within close tolerances two shifter bars between a saw collar and an associated shifter mechanism, is eliminated. Also eliminated are other problems associated with a slightly mis-mounted saw collar, such as vibration, noise, burned out saws, etc. Other advantages realized comprise a savings in manufacturing time, a savings in the number of shifter bars needed for a given machine, a reduction in the friction caused by the shifter bars, increased arbor strength and reduction in the time required to manufacture an arbor, and increased stability in a collar and in the manner in which the collar is mounted on an arbor.

These and other objects and advantages are attained by the invention, which will become more fully apparent on reading the following description, which is to be taken in conjunction with the accompanying drawings, wherein;

DETAILED DESCRIPTION OF THE INVENTION

Figure 1:
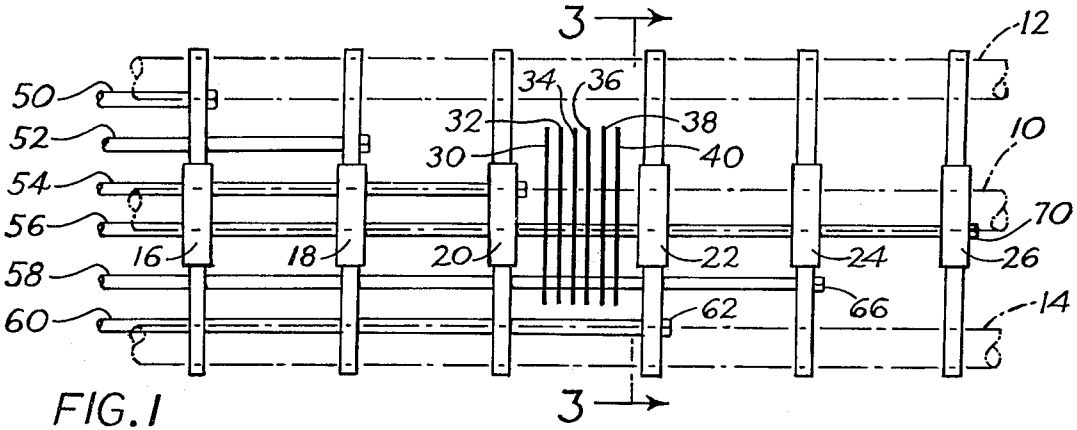
FIG. 1 is a simplified view illustrating somewhat diagramatically portions of a rip saw machine as contemplated, more particularly the arbor, shifter mechanisms and saws that typically make up such a machine.

Referring now to the drawings, and first of all more particularly to FIG. 1, the portions of the rip saw apparatus illustrated comprise a power-driven elongate saw arbor, indicated in dot-dashed outline at 10, and disposed to either side thereof, elongate support shafts 12 and 14, also indicated in dot-dashed outline. Indicated generally at 16, 18, 20, 22, 24 and 26, are what I refer to in my earlier above-indicated patent as shifter mechanisms. Circular saws encircling the arbor and driven with rotation of the arbor are indicated at 30, 32, 34, 36, 38 and 40. Three of the shifter mechanisms, namely 16, 18 and 20, are located to the left side of the bank of saws illustrated, and three of the shifter mechanisms, namely 22, 24 and 26, are located in FIG. 1 to the right of the bank of circular saws.

Figure 3:
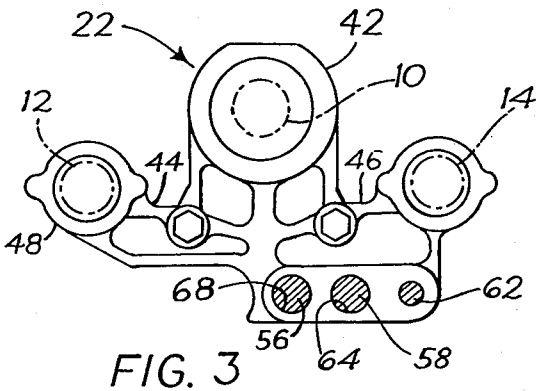
FIG. 3 is view illustrating a shifter mechanism, as such would appear when viewed along the line 3—3 in FIG. 1.

The shifter mechanisms in FIG. 1 are illustrated in simplified block type outline. Each shifter mechanism, in side elevation and as viewed along lines 3—3 in FIG. 1, as shown in FIG. 3, includes a central or arbor-embracing portion 42 which encircles saw arbor 10, and outwardly projecting arm portions 44, 46 which have at their extremities, sleeve portions 48 which encircle support shafts 12, 14. The sleeve portions mount bushings (not shown) which slidably support the sleeve portions snugly on support shafts 12, 14. A bearing assembly, to be described later, interposed between central portion 42 of the shifter mechanism and the arbor which passes therethrough, provides rotatable support for this arbor. In this way the arbor between its ends is rotatably supported by the various shifter mechanisms and the shifter mechanisms themselves are supported on support shafts 12, 14 on either side of the machine.

Shifter rods are illustrated at 50, 52, 54, 56 58, and 60. A conventional set works (not shown) including the usual fluid-operated rams is actuated to shift, selectively, the respective shifter rods in an axial direction. Each shifter rod is connected to a different shifter mechanism. Thus, rod 60 passes under shifter mechanism 16, 18, 20 to a connection 62 with shifter mechanism 22. Rod 58 passes under shifter mechanism 16, 18, 20, and through a bore 64 in shifter mechanism 22 to connection 66 with shifter mechanism 24. Shifter rod 56 passes under shifter mechanisms 16, 18, 20, and through a bore 68 in shifter mechanism 22 and a similar bore provided in shifter mechanism 24, to a connection 70 with shifter mechanism 26. In a somewhat similar manner, rods 50, 52, 54 are connected to shifter mechanism 16, 18, 20, respectively.

Each shifter mechanism is connected, by means to be described in greater detail, to a saw mounting or collar mounting one of the saws in the bank of saws, 30, 32, 34, 36, 38, 40. The connection is such that on movement of the shifter mechanism axially on the arbor, corresponding movement is produced in the collar which mounts the saw associated with the shifter mechanism. The rip saw apparatus so far described is essentially the same as the rip saw disclosed in my prior issued patent, and reference may be made thereto as to how the arbor may be driven and associated structure which may be provided for the feeding of boards into the apparatus and taking the cut product away from the apparatus.

As earlier described, a collar or saw mounting is provided for mounting each circular saw, and each shifter mechanism is connected to a different saw mounting or collar in such a manner that on movement of a shifter mechanism axially of the arbor, such movement is transmitted to the collar which is connected to it. This structure will now be described in greater detail. In this discussion, reference is principally made to FIG. 2, which is a side elevation of portions of arbor 10 and illustrating upper, arbor-embracing portions of shifter mechanism 16, 18 and 20. The shifter mechanisms are shown relatively close together in FIG. 2, which is the position that they have when the collars or saw mounts associated with the shifter mechanisms are spread apart. Further reference is made to FIG. 4, which is a cross-sectional view, on a somewhat enlarged scale, of the arbor, and illustrating a saw collar 86 as such is mounted on the arbor.

Figure 4:
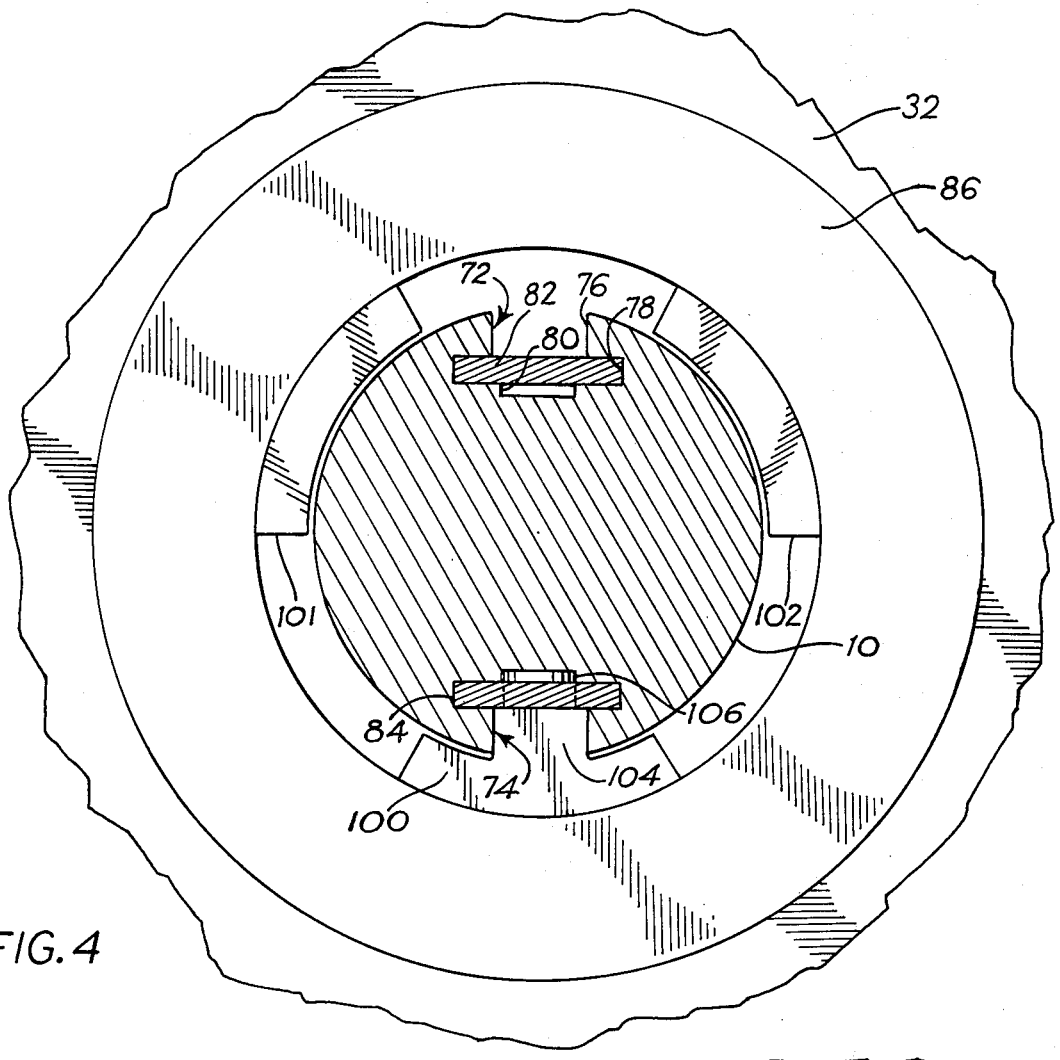
FIG. 4 is a cross-sectional view, taken generally along the line 4—4 in FIG. 2.

It will be noted, and with reference to FIG. 4, that saw arbor 10 is provided on diametrically opposite sides thereof with elongate keyways or channels, indicated generally at 72, 74. The channels have the same cross-sectional configuration, each having an outer portion 76 which joins with the periphery of the arbor, an intermediate portion 78 of somewhat greater width than portion 76 but of less depth than portion 76, and an inner portion 80 of very slight depth and slightly narrower than outer portion 76. Seated within intermediate portion 78 of channel 72, and slidable along the length of this channel, is an elongate key or shifter bar 82. Similarly, seated within the intermediate portion of channel 74 is an elongate shifter bar or key 84.

Mounting saw 32 on the arbor is a saw mount or collar indicated generally at 86. Such includes (see FIG. 2) an annular flange portion 88, an annular shoulder 90 which receives the eye of the saw, and an annular hub portion 92. A retainer ring 94 fits about this hub that is secured to the flange 88 as by fasteners 96 to secure the saw in place.

Equally circumfrentially distributed about the interior of the collar, and secured to the collar, are three cylindrically curved support pads, indicated at 100, 101 and 102, The arcuately curved inner surfaces of the pads support the collar on the saw arbor and provide the collar with what might be referred to as a three-legged support. This support is important, when it is remembered that when the saw advances into the wood during a cut, a reaction force is produced forcing the collar supporting the saw against the arbor. With the pads being equally circumfrentially distributed, the mid-region of pad 101 is 120° to one side of pad 100 and the mid region of pad 102 is 120° to the other side of pad 100. Pads 101, 102 engage the arbor where such is solid, i.e. has a cylindrical curved surface and is devoid of any channel. Margins of pad 100 engage the arbor to either side of channel 74.

Pad 100 includes a shoulder 104 extending axially along the inner side thereof which snuggly fits within the outer portion of channel 74. This serves to key the collar to the arbor whereby they rotate together. A pin projection 106 projecting radially inwardly from the shoulder and integral therewith fits within a bore provided in bar 84 and has its inner end received within the inner portion of channel 74. In this way, when the bar is shifted axially of the arbor, axial movement of the collar is produced. This is the only connection of the collar with a shifting means, the collar otherwise being free of any shifting means and the attachment described providing a single anchoring connection of the collar to the shifting means, i.e. the bar. This anchored connection rotates with the collar and arbor with rotation of these elements.

Figure 2:
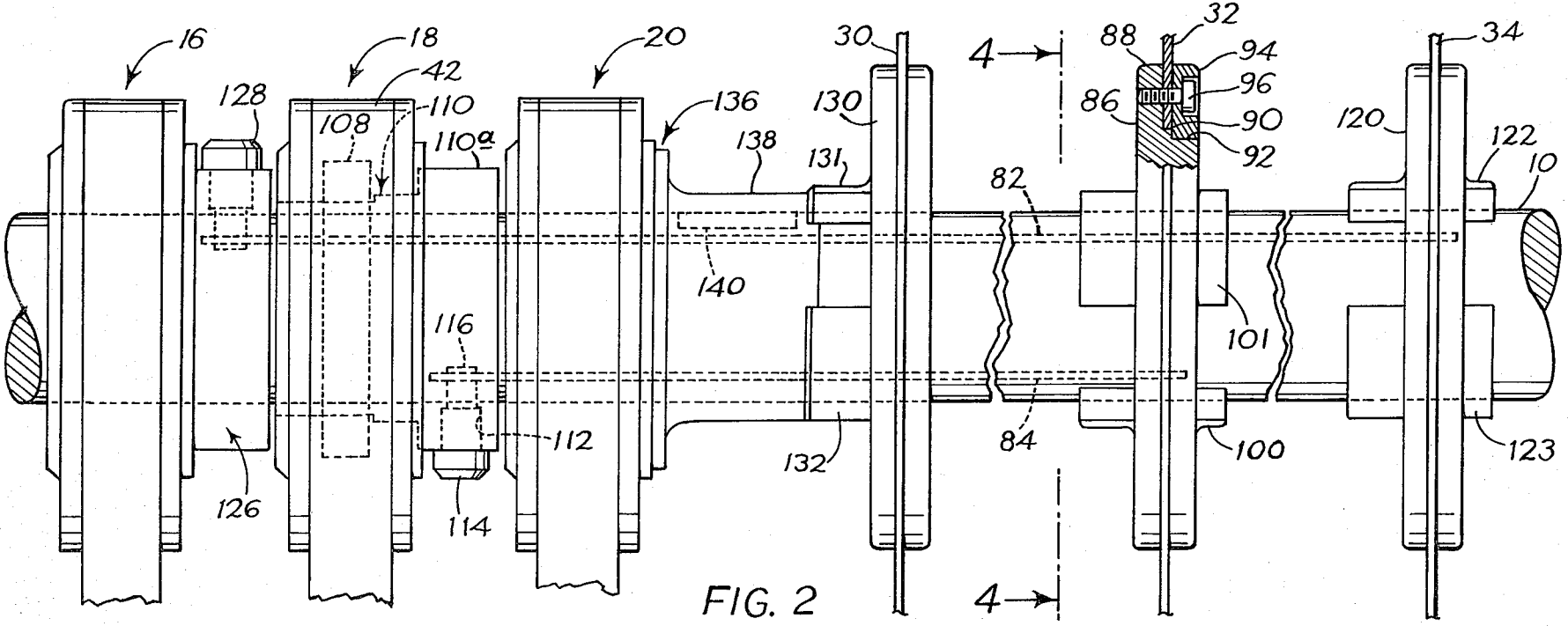
FIG. 2 is a view, on an enlarged scale and in more detail, illustrating portions of a saw arbor in the machine, collars mounting saws, and shifter mechanisms utilized in adjusting the positions of the collars.

As best illustrated in FIG. 2, arbor-embracing central portion 42 of shifter mechanism 18 has mounted therewithin a bearing assembly 108 which rotatably supports within the bearing assembly a sleeve 110 which snugly encompasses the arbor. Annular portion 110*a* of the sleeve, disposed to one side of the shifter mechanism, but an integral part of the sleeve, is provided with an internally threaded bore 112, disposed radially outwardly of channel 74 and shifter bar 84 which is lodged within this channel. A fastener 114 screwed into bore 112 has, as an integral part thereof, a pin projection 116 which extends through a bore provided in the end of shifter bar 84. Thus, shifter mechanism 18, through sleeve 110 and bar 84, is secured to collar 86 for conjoint axial movement along the arbor.

Shown at 120 in FIG. 2, is a saw mount or collar mounting circular saw 34. This collar, like collar 86, is provided with three support pads equally circumferentially distributed about the interior thereof and an integral part of the collar. These are indicated at 122 and 123, the third pad being obscured in FIG. 2 by pad 123. In this instance, pad 122 at the top of the arbor in FIG. 2 is provided with an internal shoulder (not shown), similar to shoulder 104, which fits within the channel receiving bar 82, with a pin projection (not shown) similar to pin projection 106 locking the collar to bar 82 for conjoint axial movement. Pad 123 and the one which is behind it in FIG. 2, like pads 101, 102, contact solid portions of the arbor, in this instance portions of the arbor spaced to either side of the channel receiving bar 84.

Referring to FIG. 2, shifter mechanism 16 has mounted therewithin a bearing assembly like assembly 108, but not shown in the drawing, which rotatably supports a sleeve 126. This sleeve is joined to the end of bar 82 opposite the end which is attached to collar 120, by way of a fastener 128 similar to fastener 114.

Saw 30 is mounted on a collar or saw mount 130 which resembles collars 86 and 120. Pads 131, 132, and another pad behind pad in FIG. 2 and thus not shown mount collar 130 on the arbor. A sleeve 136 is rotatably supported within shifter mechanism 20 in a manner similar to sleeve 110. Instead of the annular portion 110*a* discussed in connection with sleeve 110, sleeve 136 is provided with a tubular extension 138 which is joined as by welding to ends of pads 131, 132. Thus, instead of a shifter bar connection between the saw collar and the associated shifter mechanism to produce conjoint axial movement, in the case of collar 130, the connection is through the tubular extension described. Collar 130 and the arbor are keyed for rotation together by including on the inner side of sleeve 136 an elongate shoulder 140 which fits within the groove seating shifter bar 82.

The pads mounting collar 120 including pads 122, 123, are angularly displaced about the arbor from pads 100, 101 and 102 for collar 86. The pads have such a size that on collar 120 being shifted to the left in FIG. 2, closely adjacent collar 86, ends of pads mounting collar 120 can move into the spaces existing between the pads mounting collar 86. Similarly, the pads mounting collar 86 are angularly displaced from the pads mounting collar 130, so that the two sets of pads interfit with each other with collar 86 moved closely adjacent collar 130.

The mounting for saws 30, 32, 34 and the connections of these saws with shifter mechanism 16, 18 and 20 on one side of the machine shown in FIG. 1 has been described in detail above. Saws 36, 38 and 40 toward the opposite side of the machine from saws 30, 32 and 34 have similar mountings that are similarly connected to shifter mechanisms 22, 24, 26 on the other side of the machine.

Figure 5:
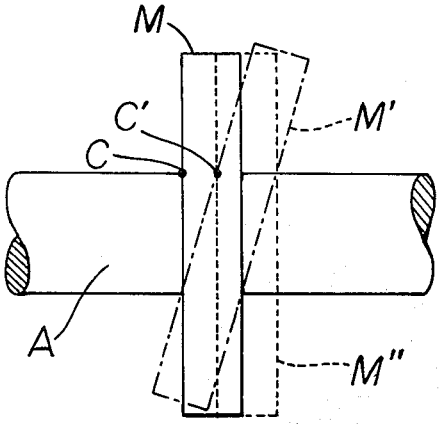
FIG. 5 is a schematic drawing illustrating, in an exaggerated way, how a saw collar operates while being shifted axially on the rotating arbor.

With the construction described, and because of the single anchored connection of saw mount 86 with its shifter bar 84, and the similar connection of saw mount 120 with its shifter bar 82, either of the saw mounts may be shifted axially on the arbor with the arbor rotating at high speed without binding of the saw mount with the arbor occurring. An action apparently takes place which is illustrated in an exaggerated manner in FIG. 5. Referring to this figure, with the arbor A rotating and before any axial adjustment is made in the saw mount M, the plane of the saw mount under the action of centrifugal force assumes a position which is exactly perpendicular to the axis of arbor A. With shifting of connection C to the right, to the position indicated at C′, there may be a tendency slightly to skew the mount, as indicated by the dot-dashed outline of the mount shown at M′. However, the rapid rotation of the arbor and mount prevents this from happening, with the mount always seeking and then maintaining a position wherein its plane is normal to the arbor axis, as indicated by the dashed outline of the mount shown at M″.

Figure 6:
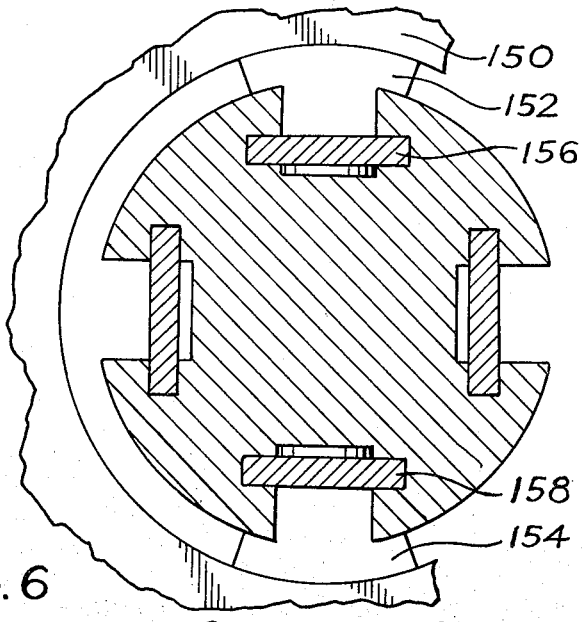
FIG. 6 (PRIOR ART)
FIG. 6 is a view similar to FIG. 4, but illustrating a prior art type of construction.

The construction is to be distinguished from what is shown in FIG. 6 wherein collar or saw mount 150 through pads 152, 154 is secured at two points to a pair of shifter bars exemplified by bars 156, 158. With this type of construction, and because of the two point connection of the mount with the shifter bars, extreme care must be taken during manufacture to prevent even minimal skewing of the mount with the assembly finally produced. If the mount is assembled in a slightly skewed state, on rotation of the arbor, such can cause the mount to become locked to the arbor, or so bound to the arbor as to severely impede axial movement. Other malfunctions previously discussed can also occur, such as excessive vibration, noise, etc.

By providing a single attachment of the shifting means with the collar, other advantages also result. The number of shifter bars required to move the saw mounts is cut in half, resulting in a stronger arbor and reducing the cost of manufacturing the arbor. With spinning of the arbor, there is a tendency for the shifter bars to be thrown radially outwardly, with friction resulting between the bars and the structure retaining them. This frictional drag is reduced when only one bar is required to move a collar instead of two. Further, of course, a greater surface area is provided on the outer surface of the arbor, devoid of any channeling, which can be utilized in providing proper support for the collar on the arbor.

While a specific embodiment of the invention has been described, it should be apparent that modifications and variations are possible without departing from the invention.

It is claimed and desired to secure by Letters Patent:

1. In saw apparatus including an elongate power-driven saw arbor and a collar adapted to mount a saw encircling said arbor and slidable axially on said arbor, a channel extending axially of the arbor, and means for shifting said collar to and fro on said arbor which, with rotation of the collar and arbor, results in centrifugal force producing positioning of the collar in a plane normal to said arbor, said shifting means comprising a rigid compression-transmitting shifter bar seating within said channel, and an attachment of said collar with said shifting means consisting of means connecting said bar with a portion of said collar disposed radially outwardly of said bar with the collar otherwise free of said shifting means, said attachment providing a single anchoring connection of the collar to the shifting means which anchoring connection, with rotation of the arbor, rotating in a path occupying a plane normal to the arbor's axis.

2. The saw apparatus of claim 1, which further comprises a first support pad mounted on a radially inner portion of the collar engaging the arbor in regions disposed directly adjacent either side of said channel, and second and third support pads separate from each other and said first support pad mounted on radially inner portions of said collar and engaging the arbor in regions located 120° to one side and 120° to the other side, respectively, of where the channel is located.

3. The saw apparatus of claim 2, wherein said arbor, in said regions engaged by said second and third pad supports, is cylindrically contoured.

4. Saw apparatus comprising:

an elongate power-driven saw arbor, a pair of collars, each adapted to mount a saw, encircling said arbor, said collars being laterally spaced and slidable axially on said arbor, a pair of channels extending exially along the arbor on diameterically opposite sides thereof, said arbor save for the regions occupied by said channels being cylindrically contoured, and shifting means for said collars for shifting the collars to and fro on the arbor with rotation of the collars and arbor resulting in centrifugal force producing positioning of the collars in planes normal to the arbor's axis, said shifting means comprising a rigid, compression-transmitting shifter bar seating within one of said channels and an attachment of one of said collars with said shifting means consisting of means connecting said bar with a portion of said one collar disposed radially outwardly of said bar with the one collar otherwise free of said shifting means, the attachment providing a single anchoring connection of the one collar to the shifting means, and another rigid compression-transmitting shifter bar seated within the other channel and an attachment of the other collar with said shifting means consisting of means connecting said other bar with a portion of said other collar disposed radially outwardly of said other bar with the other collar otherwise free of said shifting means and such attachment providing a single anchoring connection of the other collar to the shifting means, said anchoring connections with rotation of the arbor rotating in paths occupying planes normal to the arbor's axis.

5. The saw apparatus of claim 4, which further comprises first, second and third support pads for one collar mounted on radially inner portions of the one collar engaging said arbor in a region disposed directly adjacent said one channel and in regions on opposite sides of said other channel, and first, second and third support pads for said other collar mounted on radially inner portions of the other collar engaging the arbor in regions disposed directly adjacent said other channel and in regions on either side of said first-mentioned channel.

* * * * *